United States Patent [19]

Lamberty

[11] Patent Number: 4,918,409

[45] Date of Patent: Apr. 17, 1990

[54] FERRITE DEVICE WITH SUPERCONDUCTING MAGNET

[75] Inventor: Bernard J. Lamberty, Kent, Wash.

[73] Assignee: The Boeing Company, Seattle, Wash.

[21] Appl. No.: 282,554

[22] Filed: Dec. 12, 1988

[51] Int. Cl.[4] ..... H01P 1/387

[52] U.S. Cl. ..... 333/1.1; 333/99 S; 335/216; 505/866; 505/879

[58] Field of Search ..... 333/1.1, 24.1–24.3, 333/158, 99 S; 335/216; 505/866, 879

[56] References Cited

U.S. PATENT DOCUMENTS

| | | | |
|---|---|---|---|
| 3,158,794 | 11/1964 | Swartz | 335/216 |
| 3,214,249 | 10/1965 | Bean et al. | 333/99 S X |
| 3,355,680 | 11/1967 | Saltzman et al. | 333/1.1 |
| 3,534,296 | 10/1970 | Carr | 333/1.1 |
| 3,710,280 | 1/1973 | Buck | 333/1.1 |
| 3,854,106 | 12/1974 | Tresselt | 333/1.1 |
| 4,187,470 | 2/1980 | Clauss et al. | 330/4 |
| 4,437,080 | 3/1984 | Ekin et al. | 335/216 |
| 4,453,149 | 6/1984 | Rios | 335/216 |

FOREIGN PATENT DOCUMENTS

| | | | |
|---|---|---|---|
| 191407 | 11/1983 | Japan | 505/879 |
| 194309 | 11/1983 | Japan | 335/216 |

*Primary Examiner*—Paul Gensler

*Attorney, Agent, or Firm*—Indyk, Pojunas & Brady

[57] ABSTRACT

A ferrite device has a closed superconductor which encircles a ferrite element. The closed superconductor continuously circulates a current to produce a magnetic field for biasing the ferrite element.

16 Claims, 12 Drawing Sheets

FIG. 3 PRIOR ART
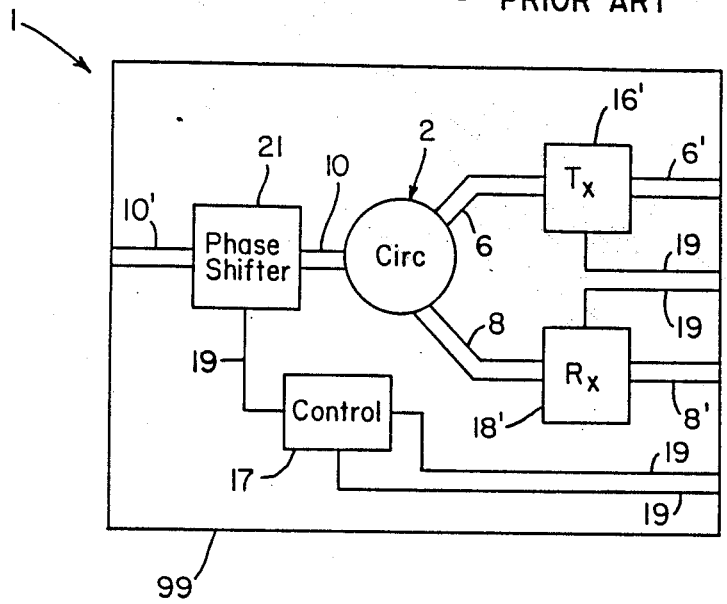
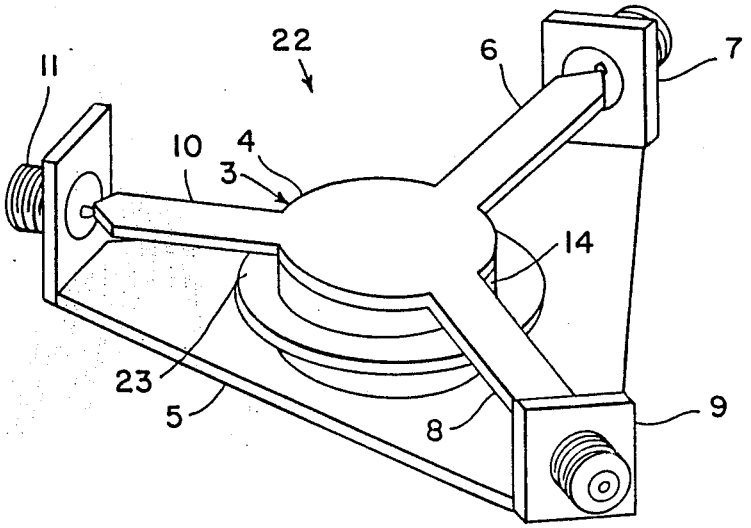
FIG. 4b

FERRITE DEVICE WITH SUPERCONDUCTING MAGNET

FIELD OF THE INVENTION

This invention relates to devices which control the transmission of electromagnetic wave energy, and more particularly, to ferrite devices having magnetically biased ferrite elements.

BACKGROUND OF THE INVENTION

Ferrite devices are used extensively to control the propagation of high frequency electromagnetic wave energy, particularly energy in the microwave and millimeter wave spectrums. These devices include a wave transmission system, which may use waveguide, stripline, microstrip, or coaxial transmission line technology, and magnetically biased ferrite material located in or adjacent to the wave transmission system.

Typically, the ferrite material is magnetically biased by applying a constant magnetic field whose direction and magnitude are selected to produce a desired attenuation, phase shift, or diversion of electromagnetic wave energy propagating in the wave transmission system. Presently, ferrite devices use permanent magnets or electromagnets requiring power supplies to provide the required constant magnetic field.

The size and weight of permanent magnets or electromagnets add significantly to the size and weight of ferrite devices. In fact, such magnets often weigh several times more than the combined weight of all the other components in the ferrite device. The added size and weight are particularly significant at higher microwave and millimeter wave frequencies since the strength of the constant magnetic field and, therefore, the size and weight of the magnet required for proper operation of the ferrite device increase as the frequency of electromagnetic wave energy propagating in the wave transmission system increases.

The term "ferrite device" as used in this application refers to any device which relies on the interaction of electromagnetic wave energy propagating in a wave transmission system with magnetically biased ferrite material to control the wave energy in a desired manner.

Well known ferrite devices include circulators, isolators, attenuators, switches, modulators, yttrium iron garnet (YIG) filters, and phase shifters, among others.

While the present invention is applicable to all such ferrite devices, the preferred embodiment will be described as applied to a circulator, one of the most widely used ferrite devices.

A conventional microstrip junction circulator 2 of the type commonly used in transmit/receive systems for duplexing a transmitter and receiver to a common antenna is shown in FIGS. 1*a* and 1*b*, in exploded and perspective views, respectively. Microstrip junction circulator 2 is designed to provide an impedance match between the antenna and the transmitter and receiver and to protect sensitive circuitry in the receiver from high power produced by the transmitter while the system is transmitting.

Microstrip junction circulator 2 includes a ground plane 5 and a microstrip conductor 3 having a junction 4 which is connected to radially extending transmission lines 6, 8, and 10. A ferrite disk 14 is located between junction 4 and ground plane 5. Transmission lines 6, 8, and 10 are connected to center conductor pins 13 of coaxial connectors 7, 9, and 11, respectively. Ground plane 5 has a notch 15 to accept permanent magnet 12. Permanent magnet 12 produces a constant magnetic field which biases ferrite disk 14 and is substantially parallel to the axis of ferrite disk 14.

As is well known, by magnetically biasing ferrite disk 14 of circulator 2 with a constant magnetic field which is of appropriate strength and substantially parallel to its axis, electromagnetic wave energy received over one transmission line is caused to propagate in a circular direction around ferrite disk 14 to the next transmission line. The direction in which the electromagnetic energy propagates depends on the polarity of the constant magnetic field.

FIG. 1*c* is a schematic diagram illustrating the operation of circulator 2 in a transmit/receive system. As shown in FIG. 1*c*, transmission line 6 is connected to a transmitter 16; transmission line 8 is connected to a receiver 18; and transmission line 10 is connected to an antenna 20. The polarity of the constant magnetic field produced by magnet 12 is such that electromagnetic wave energy received by transmission line 10 from antenna 20 is circulated in a counterclockwise direction around ferrite disk 14 to transmission line 8 where it is coupled to receiver 18. Transmission line 6 and transmitter 16 are thereby isolated from electromagnetic wave energy received by transmission line 10 from antenna 20.

The constant magnetic field produced by magnet 12 will also cause electromagnetic wave energy received by transmission line 6 from transmitter 16 to circulate in a counterclockwise direction around ferrite disk 14 to transmission line 10 where it is coupled to antenna 20. Transmission line 8 and receiver 18 are thereby isolated from high power electromagnetic wave energy produced by transmitter 16.

FIGS. 2*a* and 2*b* show exploded and side views, respectively, of a conventional stripline circulator 2' which operates in the same manner as the microstrip junction circulator 2 of FIG. 1*a* and 1*b*. Stripline circulator 2' has a stripline center conductor 3 located between a lower ground plane 5 and an upper ground plane 5'. Stripline center conductor 3 has a junction 4 which is connected to radially extending transmission lines 6, 8, and 10. Ferrite disk 14 is mounted between junction 4 and lower ground plane 5. Ferrite disk 14' is mounted between junction 4 and upper ground plane 5'. Transmission lines 6, 8, and 10 are connected to center conductor pins 13 of coaxial connectors 7, 9, and 11, respectively. Permanent magnet 12' produces a constant magnetic field which biases ferrite disks 4 and 14' as required for circulator operation.

Circulators of the type shown in FIGS. 1*a*, 1*b*, 2*a*, and 2*b* typically provide 15 to 20 dB of isolation over a specified bandwidth. Greater isolation can be achieved by cascading circulators together in a known manner.

A current state-of-art use for such circulators is in hybrid microwave integrated circuits (MICs) such as the T/R (transmit/receive) module 1 for a phased array radar shown in FIG. 3. A large multiple of such modules are used in the radar. Transmitter 16', receiver 18', phase shifter 21 and control circuit 17 are individual monolithic microwave integrated circuits (MMICs) which can be manufactured inexpensively and repetitiously by MMIC foundries.

One of the advantages of this arrangement is that a microstrip version of a circulator 2 can be integrated in the module substrate 99 without requiring connectors. Components are integrated via interconnecting microstrip transmission lines 6, 8 and 10. The individual circuits are powered and controlled by integrated conductors 19. The transmission line 10' at one end of the module feeds an antenna element (not shown) in the array. The transmission lines 6' and 8' and DC and control wires 19 at the other end of the module are connected to combiners and distribution networks (not shown) essential to proper operation of the radar. In current radars, the weight of the module 1 is frequently dominated by that of the magnet required by the circulator 2, thereby limiting benefits made possible by hybrid MIC and MMIC technology.

One known method of avoiding the weight penalty of circulator magnets is to use a solid state switching system at each antenna element, instead of a circulator, to isolate the transmitter and receiver. However, unlike circulators, solid state switching systems cannot preserve a constant impedance match to the transmitter and receiver as a function of scan angle. They are also more lossy than circulators and require logic circuitry which adds to system complexity. The added complexity results in reduced mean time to failure and hence reduced system reliability. As a result, where constant impedance, reliability, and energy loss are critical, circulators should be used despite the weight penalty of the circulator magnets.

In addition, there are certain applications, such as in fm or cw communication systems, where solid state switching systems cannot be used. In such applications, circulators are required and the weight penalty introduced by circulator magnets is unavoidable.

Accordingly, a need exists for a constant magnetic field source for circulators and other ferrite devices which is lightweight and compact.

SUMMARY OF THE INVENTION

It is an object of the invention to provide an improved ferrite device which does not require a permanent magnet or an electromagnet having a power supply.

It is an object of the invention to provide an improved ferrite device having a lightweight and compact magnetic field source for magnetically biasing a ferrite element.

It is also an object of the invention to provide a magnetic field source which is compatible with MIC, hybrid MIC and MMIC, and MMIC techniques.

These and other objects are achieved by the present invention in which a ferrite device is provided with a superconductor which encircles a ferrite element. The superconductor may be a thick or a thin film of superconducting material. A continuously circulating current in the superconductor induces a magnetic field which magnetically biases the ferrite element as required for the ferrite device to operate.

In accordance with another aspect of the invention, the strength of the magnetic field biasing the ferrite element may be increased by providing the ferrite device with a plurality of superconductors which encircle the ferrite element or a superconductor having a coil which encircles the ferrite element.

BRIEF DESCRIPTION OF THE DRAWINGS

FIG. 3 is a schematic diagram of a T/R module application for conventional circulators.

FIG. 4*b* is a perspective view of the first embodiment of the invention.

DETAILED DESCRIPTION OF THE INVENTION

Figure 1A:
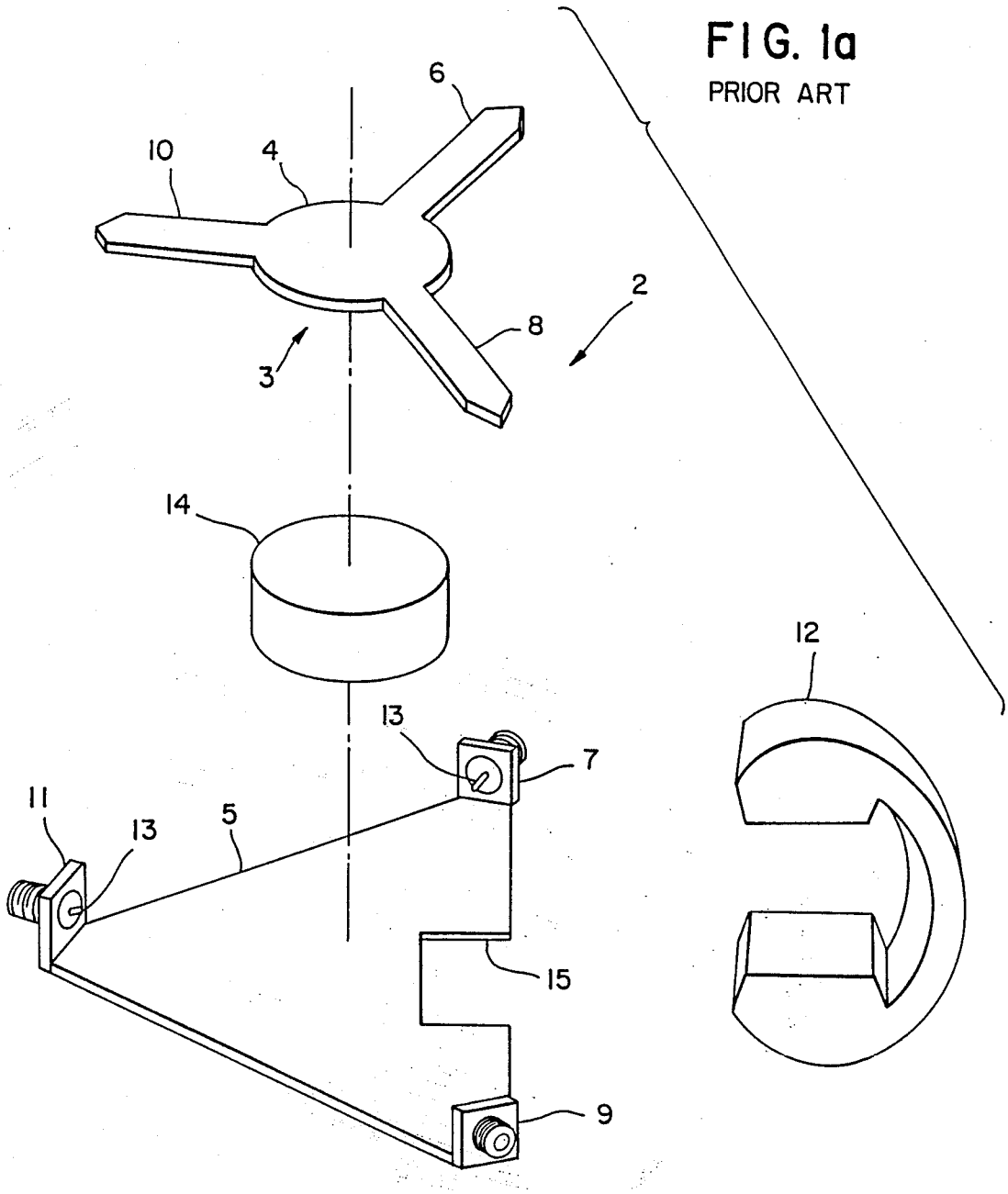
FIG. 1a PRIOR ART
FIG. 1*a* is an exploded view of a conventional microstrip circulator.
Figure 1B:
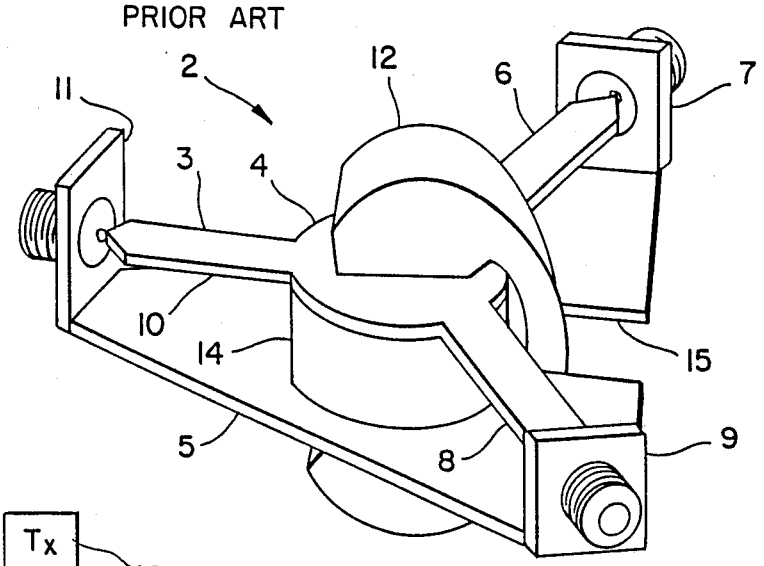
FIG. 1b PRIOR ART
FIG. 1*b* is a perspective view of a conventional microstrip circulator.
Figure 1C:
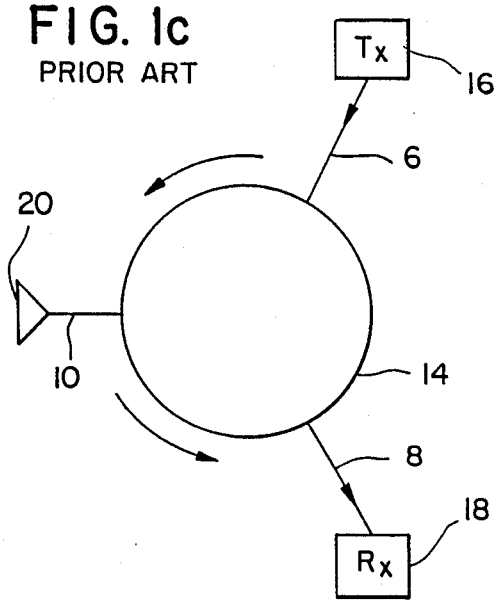
FIG. 1c PRIOR ART
FIG. 1*c* is a schematic diagram illustrating the operation of a circulator in a transmit/receive system.
Figure 2B:
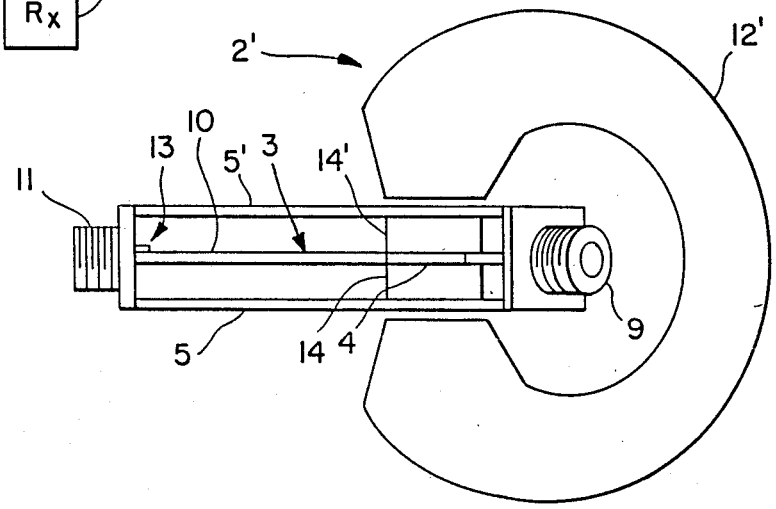
FIG. 2b PRIOR ART
FIG. 2*b* is a side view of a conventional stripline circulator.
Figure 2A:
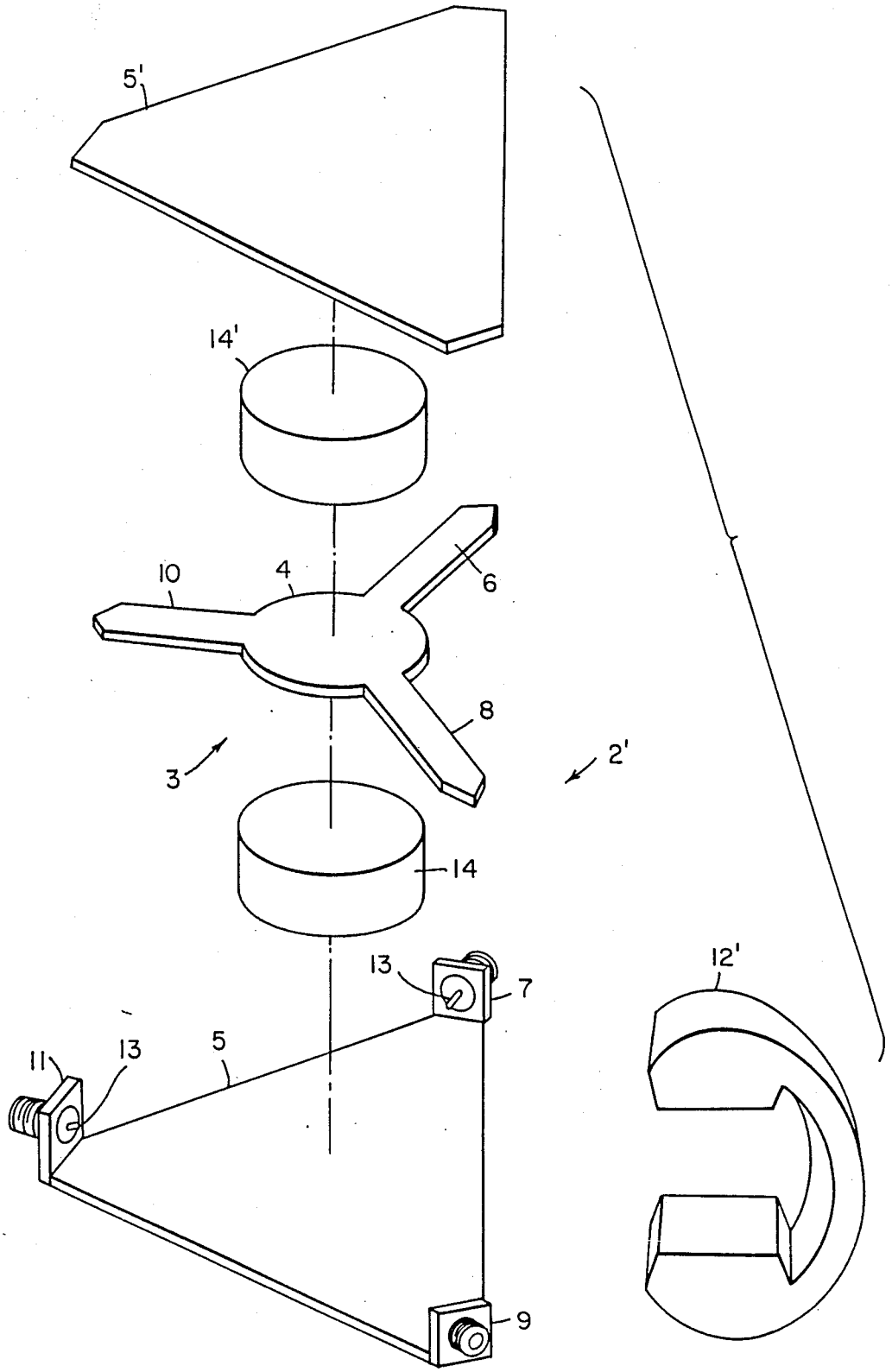
FIG. 2a PRIOR ART
FIG. 2*a* is an exploded view of a conventional stripline circulator.
Figure 4A:
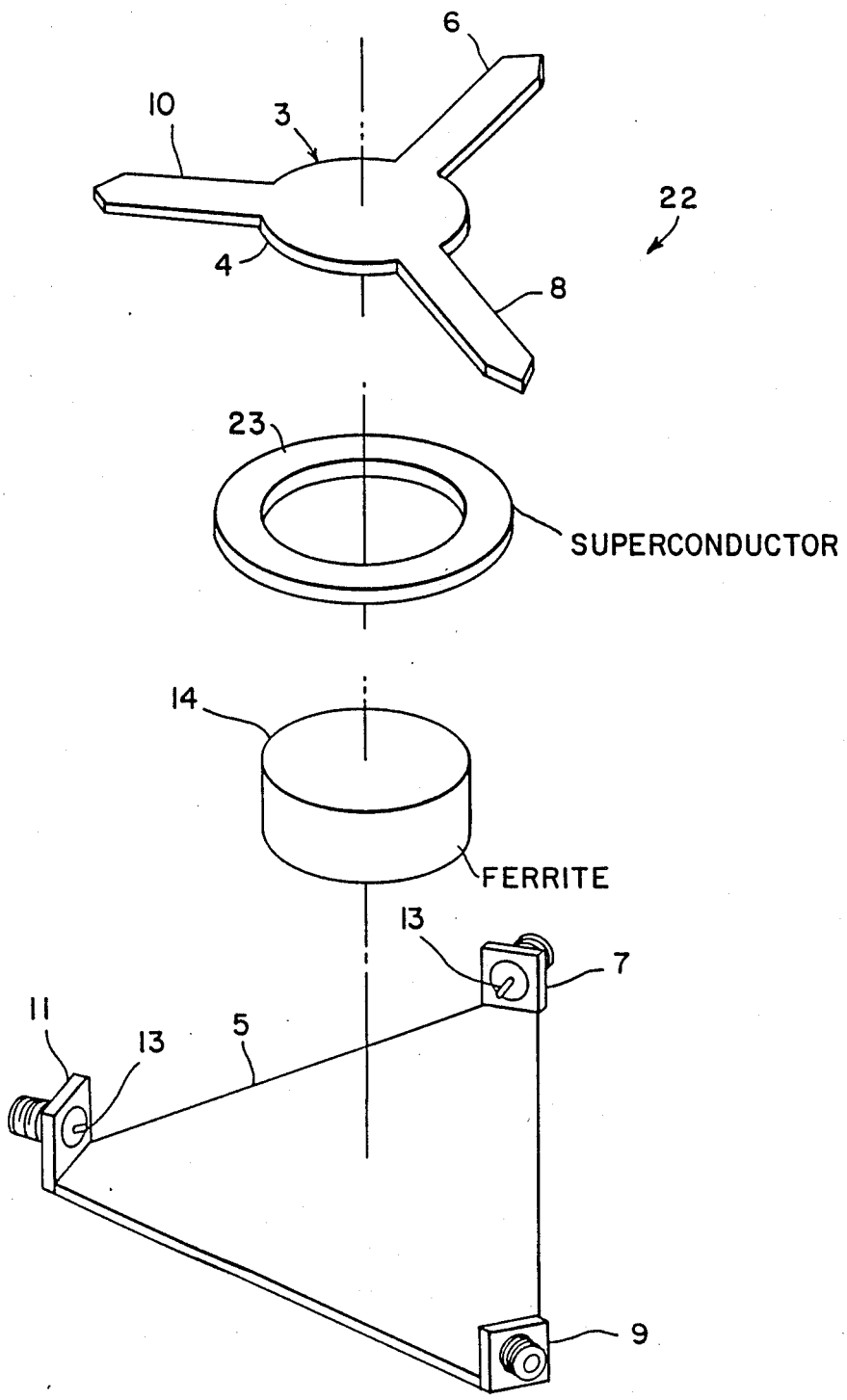
FIG. 4*a* is an exploded view of a first embodiment of the invention.
Figure 4C:
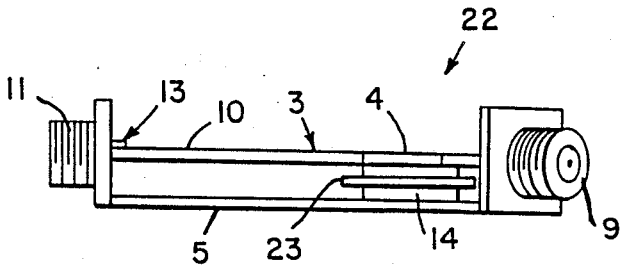
FIG. 4*c* is a side view of the first embodiment of the invention.

FIGS. 4*a*, 4*b*, and 4*c* show exploded, perspective, and side views, respectively, of a microstrip junction circulator 22 according to the invention. Microstrip junction circulator 22 includes a ground plane 5 and a microstrip conductor 3 which has a junction 4 which is connected to radially extending transmission lines 6, 8, 10. Transmission lines 6, 8, and 10 are connected to center conductor pins 13 of coaxial connectors 7, 9, and 11, respectively. A ferrite disk 14 is located between junction 4 and ground plane 5 and, when biased by the appropriate constant magnetic field, controls the propagation of electromagnetic wave energy in the conventional manner described above with respect to FIGS. 1*a*, 1*b*, and 1*c*.

A ring 23 of superconductive material encircles ferrite disk 14 and is closed to provide a continuous current path around ferrite disk 14. Superconductor ring 23 preferably contacts ferrite disk 14 and is disposed in a plane perpendicular to the axis of ferrite disk 14 and equidistant from the top and bottom surfaces of ferrite disk 14. Superconductor ring 23 may be held in position by an adhesive, for example, which bonds it to ferrite disk 14. As will be described below with respect to FIG. 8, the magnetic field required to bias ferrite disk 14 for circulator operation is produced by an induced current which continuously circulates in superconductor ring 23.

Figure 5B:
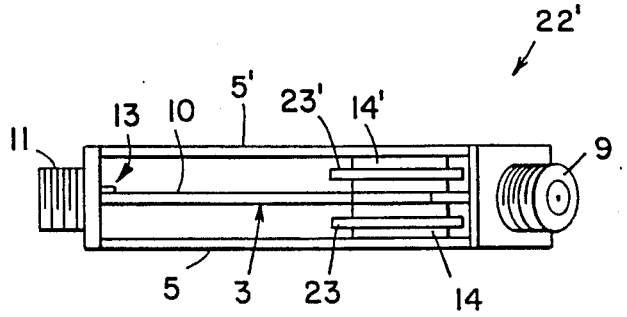
FIG. 5*b* is a side view of the second embodiment of the invention.
Figure 5A:
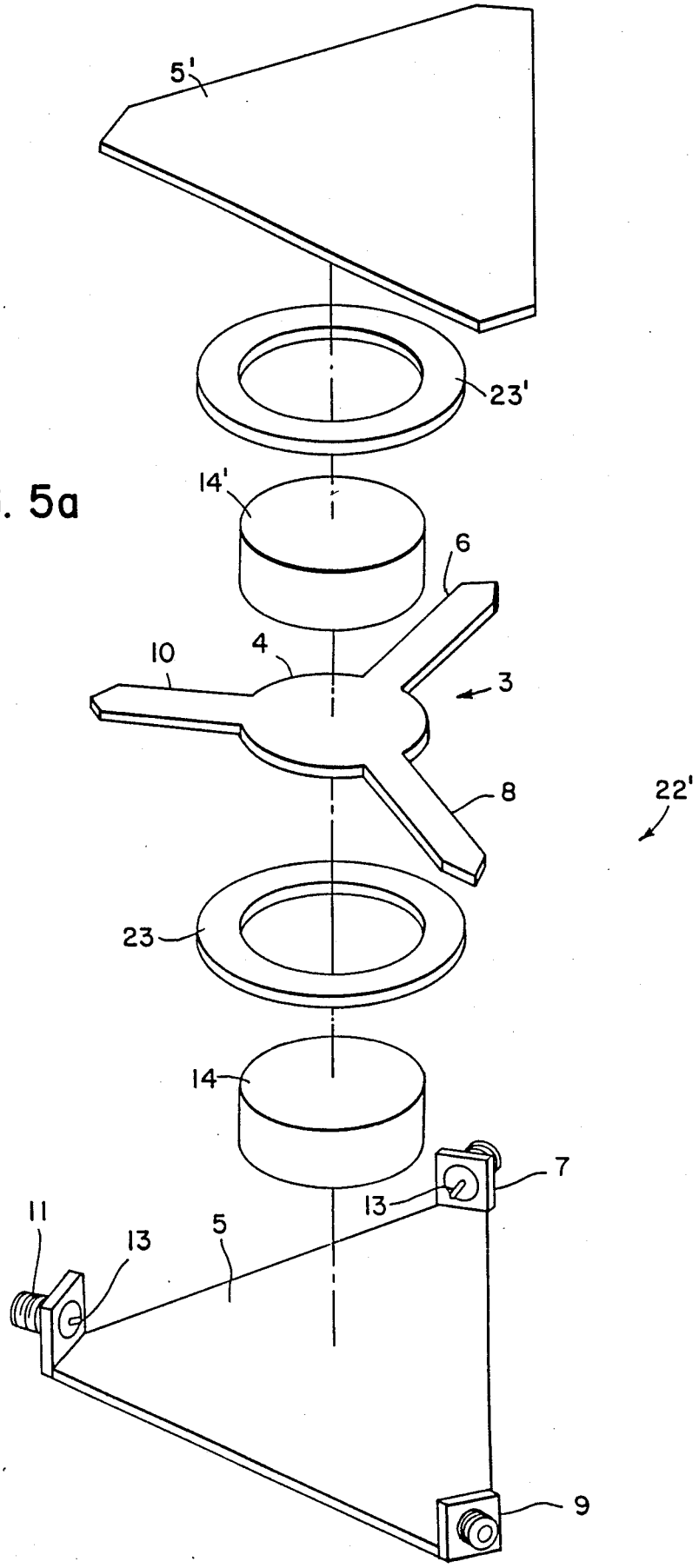
FIG. 5*a* is an exploded view of a second embodiment of the invention.

FIG. 5*a* and 5*b* show exploded and side views, respectively, of a stripline embodiment of this invention. Stripline circulator 22' has a stripline center conductor 3 located between lower ground plane 5 and upper ground plane 5'. Stripline center conductor 3 has a junction 4 which is connected to radially extending transmission lines 6, 8, and 10. Transmission lines 6, 8, and 10 are connected to center conductor pins 13 of coaxial connectors 7, 9, and 11, respectively. Ferrite disk 14 is mounted between lower ground plane 5 and junction 4. Ferrite disk 14' is mounted between junction 4 and upper ground plane 5'.

Rings 23 and 23' of superconductive material encircle ferrite disks 14 and 14', respectively. Each of the superconductor rings 23 and 23' is preferably disposed in a plane perpendicular to the axis of the ferrite disks and equidistant from the top and bottom surfaces of the ferrite disk it encircles. Superconductor rings 23 and 23' may be held in position by an adhesive, for example, which bonds them to ferrite disks 14 and 14', respectively. The magnetic field required to bias ferrite disks 14 and 14' for circulator operation is produced by currents circulating continuously in superconductor rings 23 and 23'.

Figure 6C:
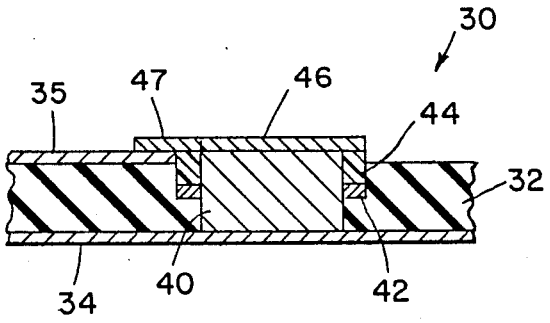
FIG. 6*c* is a cross-section of the third embodiment of the invention.
Figure 6A:
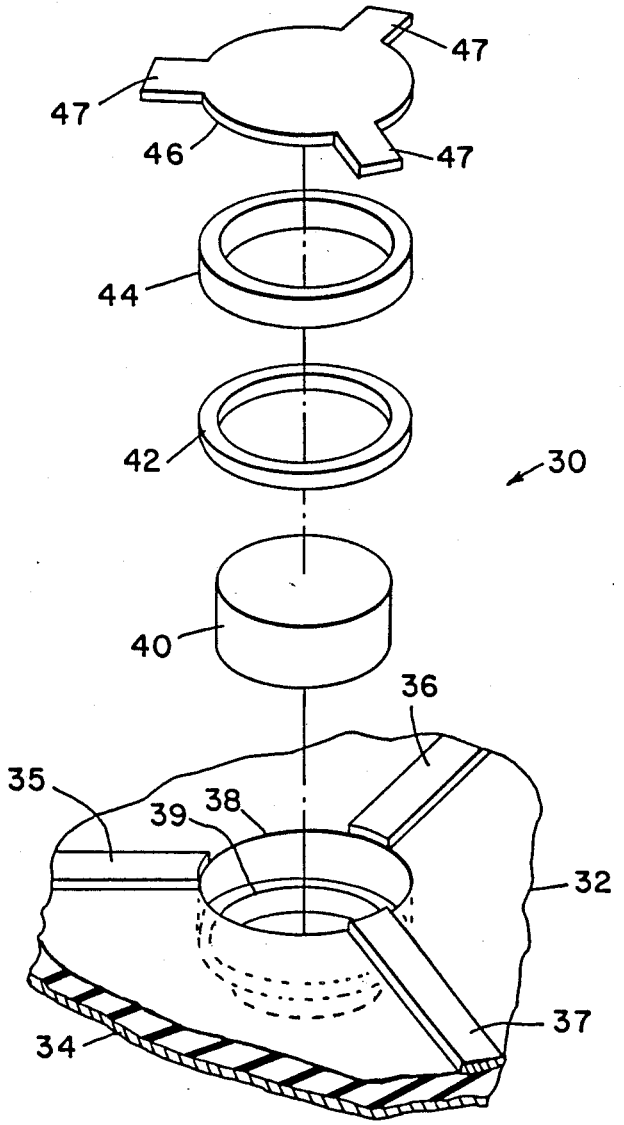
FIG. 6*a* is an exploded view of a third embodiment of the invention.
Figure 6B:
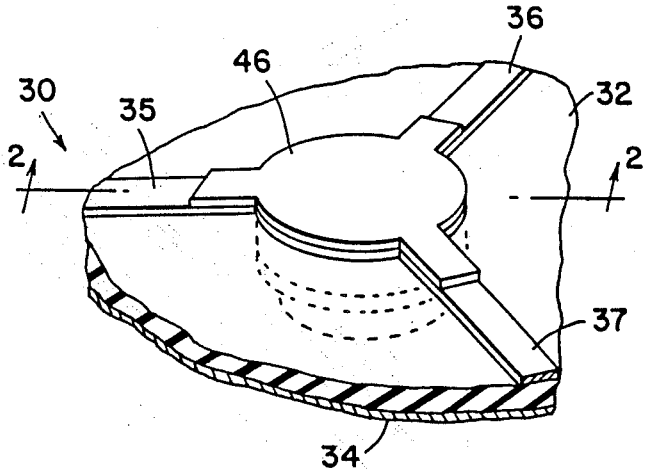
FIG. 6*b* is a perspective view of the third embodiment of the invention.

FIGS. 6*a* and 6*b* show exploded and perspective views, respectively, of a printed circuit embodiment of the invention. FIG. 6*c* shows a cross-section taken along section lines 2—2 of FIG. 6*b*. Printed circuit circulator 30 includes a substrate 32 having a ground plane 34 on its bottom surface. Ground plane 34 may be formed by deposition of a metallization layer on the bottom surface of substrate 32, for example. Printed circuit transmission lines 35, 36, and 37 are formed on the top surface of substrate 32 and extend radially from a stepped hole 38.

Stepped hole 38 extends from the top surface of substrate 32 through to ground plane 34. Stepped hole 38 may be formed using well known etching, machine, or laser cutting techniques. Stepped hole 38 has a first diameter extending from the top surface of substrate 32 to step 39 and a second diameter extending from step 39 to ground plane 34. The first diameter of stepped hole 38 is larger than and concentric with its second diameter. Ferrite cylinder 40, which has a diameter equal to the second diameter of hole 38, is mounted in stepped hole 38 in contact with ground plane 34.

A ring 42 of superconductive material, which has an outside diameter equal to the first diameter of stepped hole 38 and a inside diameter equal to that of ferrite cylinder 40, is mounted in stepped hole 38 around ferrite cylinder 40 and in contact with step 39. Step 39 is preferably located so as to position superconductor ring 42 in a plane perpendicular to the axis of ferrite cylinder 40 and equidistant from the top and bottom surfaces of ferrite cylinder 40. Dielectric spacer ring 44, which has the same inside and outside diameters as superconductor ring 42, is mounted in stepped hole 38 around ferrite cylinder 40 and in contact with superconductor ring 42.

Metal cap 46 contacts transmission lines 35, 36, and 37, dielectric spacer ring 44, and ferrite cylinder 40. Metal cap 46 forms a continuous electrical junction connecting transmission lines 35, 36, and 37 when tabs 47 on cap 46 are soldered to transmission lines 35, 36, and 37. When metal cap 46 is soldered in place, dielectric spacer 44 holds superconductor ring 42 in position and insulates superconductor ring 42 from metal cap 46. The top and bottom surfaces of ferrite cylinder 40 are preferably metallized to provide good electrical contact with ground plane 34. The magnetic field required to bias ferrite cylinder 40 for circulator operation is produced by an induced current which continuously circulates in superconductor ring 42.

As shown in FIGS. 4*a*–6*c*, superconductor rings 23, 23', and 42 are preferably thin, flat rings of superconductive material. However, thick rings and other forms of superconductive material, such as filaments, could also be used.

Figure 7B:
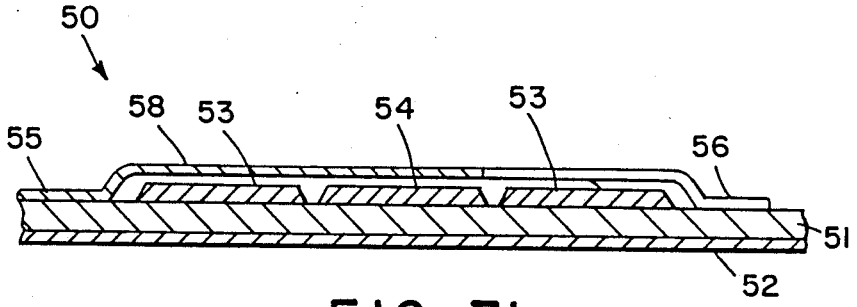
FIG. 7*b* is a cross-section of the fourth embodiment of the invention.
Figure 7A:
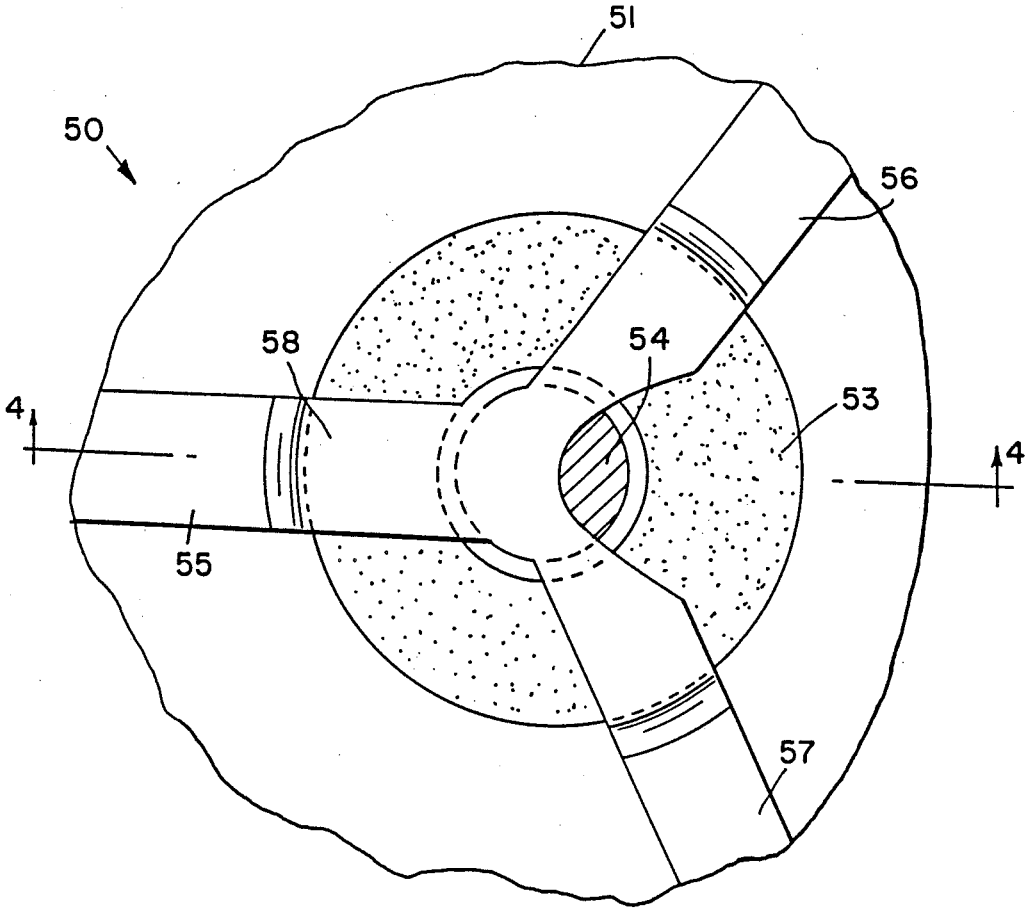
FIG. 7*a* is a partial section top view of a fourth embodiment of the invention.

FIG. 7*a* shows a partial-sectional top view of a monolithic microwave integrated circuit (MMIC) embodiment, which is the preferred embodiment of the invention. FIG. 7*b* shows a cross-section taken along section lines 4—4 of FIG. 7*a*. MMIC circulator 50 includes a substrate 51, which may be silicon, for example, having a ground plane 52 formed on its bottom surface. Ground plane 52 may be formed by deposition of a metallization layer on the bottom surface of substrate 51. Ferrite element 54 is formed by depositing a thin cylinder of ferrite on the top surface of substrate 51.

A ring 53 of superconductive material is deposited on the top surface of substrate 51 surrounding ferrite element 54. Superconductor ring 53 may be deposited as an annular thick-film or thin-film of superconductive material. Microstrip transmission lines 55, 56, and 57 are metal deposited on the top surface of substrate 51 and are spaced apart from superconductor ring 53 and extend in a radial direction from ferrite element 54. A metal junction 58 connects transmission lines 55, 56, and 57 without contacting superconductor ring 53. Metal junction 58 may be an air bridge metal junction, as shown in FIGS. 7*a* and 7*b*, formed by well known MMIC foundry techniques and separated from superconductor ring 53 and ferrite element 54 by an air gap. Alternatively, metal junction 58 may be deposited on a dielectric layer which has been deposited on superconductor ring 53, ferrite element 54, and substrate 51. In this case, metal junction 58 is separated from superconductor ring 53 and ferrite element 54 by the dielectric layer, which may be silicon nitride, for instance. The magnetic field required to bias ferrite element 54 for circulator operation is produced by an induced current which circulates in superconductor ring 53.

Superconductor rings 23, 23', 42, and 53 of FIGS. 4*a*–7*b* may be formed from any known superconductive material, including metals, alloys, compounds, or ceramics, capable of sustaining a magnetic field of sufficient strength for the circulator to operate. Magnetic field strengths in the range of 1000 to 5000 gauss are typically required for circulators operating on electromagnetic wave energy in the microwave and millimeter wave bands. Materials which enter the superconducting state at relatively high temperatures are preferred since less energy is consumed to maintain the superconducting state. Examples of suitable materials for the present invention include NbTi, $Nb_3Sn$, $PbMo_6S_7$ which are superconducting near 4 degrees Kelvin and $YBa_2Cu_3O_7$ which is superconducting at 77 degrees Kelvin.

The induced current which circulates continuously in superconductor rings 23, 23', 42, and 53 of FIGS. 4a–7b to produce the magnetic field necessary for circulator operation is produced by first imposing an external magnetic field on the superconductor ring. The superconductor ring is then placed in the superconductive state, preferably by cooling. The external magnetic field is then removed from the superconductor ring, thus changing the magnetic field linking the ring and thereby inducing a current in the ring. As long as the superconductor ring remains in the superconductive state, the induced current will circulate continuously and the superconductor ring will act as a superconducting magnet.

Figure 8:
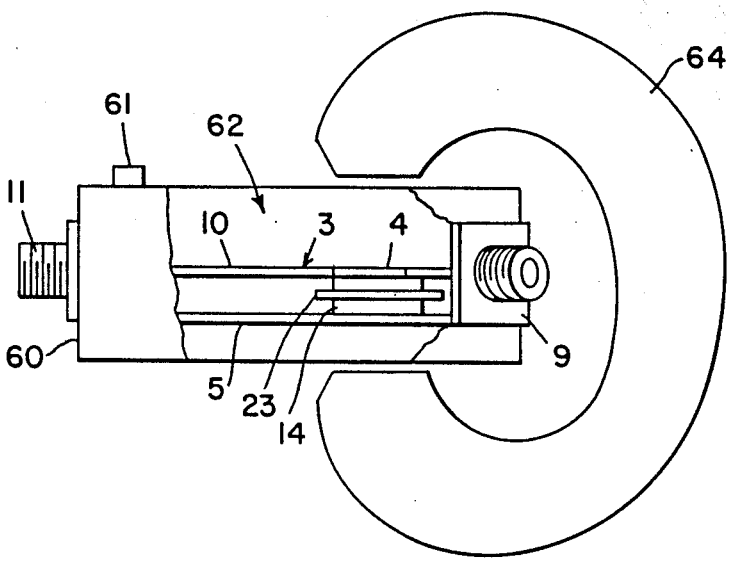
FIG. 8 illustrates the operation of the invention.

FIG. 8 illustrates the operation of a circulator according to the invention. Although the operation of the present invention is described with respect to circulator 22 of FIGS. 4a–4c, the operation of circulators 22', 30, and 50 of FIGS. 5a–7b is identical. Until high temperature superconductors are readily available, cryostat cooling devices are needed for the invention. For example, circulator 22 of FIGS. 4a–4c may be housed in cryostat 60, as shown in FIG. 8, which is capable of maintaining superconductor ring 23 at a sufficiently low temperature for superconductor ring 23 to achieve the superconducting state. Cryostat 60 has a valve 61 through which a coolant fluid can be introduced into and removed from interior chamber 62. An external magnet 64, which may be either a permanent magnet or an electromagnet, is provided for imposing an external magnetic field on superconductor 23.

In operation, magnet 64 is first positioned adjacent circulator 22 to impose an external magnetic field on superconductor ring 23. A transition to the superconducting state is then induced in superconductor ring 23, preferably by cooling it to below its critical temperature. This cooling can be achieved by introducing a coolant fluid into cryostat 60 via valve 61. Liquid helium is a suitable coolant for superconductors formed of compounds of metals, such as lead or niobium, which must be operated near 4 degrees Kelvin. Liquid nitrogen is a suitable coolant fluid for ceramic superconductors, such as $YBa_2Cu_3O_7$ which can operate at temperatures near 77 degrees Kelvin. As high temperature superconductors become available superconductivity may be initiated and sustained by a flow of cooled ambient air, thus rendering a cryostat unnecessary.

After placing the superconductor ring 23 in the superconducting state, the magnetic field imposed on superconductor ring 23 by magnet 64 is removed. Removal of the magnetic field can be achieved by either physically separating magnet 64 from the circulator 22 or, where magnet 64 is an electromagnet, by turning the electromagnet off. Removal of the magnetic field causes the magnetic field linking superconductor ring 23 to change. As is well known from Faraday's law of electromagnetics, a changing magnetic field linking a conductor induces a current in that conductor.

Since superconductor ring 23 is in the superconducting state and therefore has zero resistance, the current induced in it by removing the magnetic field of magnet 64 will not be attenuated and will continuously circulate around superconductor ring 23.

This continuously circulating current will itself induce a constant magnetic field as is known from Ampere's law:

$$SB \cdot dl = uI$$

where B is the magnetic field integrated around a path which encloses the conductor;

dl is the incremental path length of integration;

u is the permeability of the conductor; and

I is the current in the conductor enclosed by B.

The magnetic field produced by the current circulating in superconductor ring 23 is toroidal in shape. By locating superconductor ring 23 in a plane substantially perpendicular to the axis of ferrite disk 14 and equidistant from the top and bottom surfaces of ferrite disk 14, the magnetic field induced by the continuously circulating current in the vicinity of ferrite disk 14 will be substantially parallel to the axis of ferrite disk 14 as is required for circulator 22 to operate. Superconductor ring 23 preferably contacts ferrite disk 14 in order to apply the full strength of the magnetic field to ferrite disk 14.

As can be seen from Ampere's law, the strength of the magnetic field produced by superconductor ring 23 is a function of the magnitude of the current circulating in superconductor ring 23. As is apparent from Faraday's law of electromagnetics, the magnitude of the current circulating in superconductor ring 23 is, in turn, a function of the magnitude and rate of change of the externally applied magnetic field of magnet 64. Therefore, by controlling the magnitude of the field applied by magnet 64 and the rate at which the field is removed, the magnitude of the circulating current can be adjusted to produce a constant magnetic field having the required strength to operate circulator 22.

The magnetic field produced by superconductor ring 23 is "trapped" in the sense that as long as the current continues to circulate in superconductor ring 23, the magnetic field will be produced. Superconductor ring 23 of the present invention thus eliminates any further need for a permanent magnet or electromagnet having a power supply in the circulator as long the superconducting state is maintained.

The size and weight of the superconductor ring 23 necessary to provide the required constant magnetic field for circulator operation are significantly less than the size and weight of a permanent magnet or electromagnet producing a field of the same strength. This is due to the fact that a superconducting material can sustain a very large current density. As mentioned earlier, the additional weight of the cryostat and coolant is expected to be unnecessary as higher temperature superconductors become available.

However, there is a limit on the current density which can be sustained in superconducting materials. If this limit, known as critical density, is exceeded, the superconductor will cease operating in the superconducting state and will revert to the resistive state. The critical density is a function of the type of superconductive material and how close that material is operating to its critical temperature.

Superconducting metals, such as compounds of lead and niobium, can sustain current densities on the order of 10 mega-amps per square centimeter. Superconducting ceramics, such as $YBa_2Cu_3O_7$, can sustain current densities of approximately 100,000 amps per square centimeter. Although even the lower value has been determined by calculations made by the inventor to be adequate to sustain the magnetic field required by typical microwave ferrite circulators, some high temperature superconductors may not be capable of sustaining such high current densities. There also may be other applications where higher current densities are required.

Consequently, when the superconductor rings of the present invention are operating close to critical density, attempting to increase the strength of the constant magnetic field by increasing the current induced in the superconductor rings may result in the current density exceeding the critical density. In such a situation, the superconductor rings will revert to the resistive state and the induced current will quickly stop circulating. The constant magnetic field biasing the ferrite will therefore vanish and the circulators will cease operating.

Where a superconductor ring is operating close to its critical density and the strength of the magnetic field must be increased, the current carrying capability of the superconductor can be increased by increasing the cross-sectional area of the superconductor.

Figure 9A:
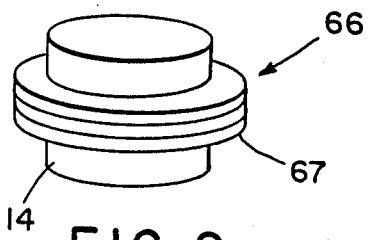
FIG. 9*a* shows a perspective view of a laminated superconductor ring which may be used in the first, second, and third embodiments of the invention.

FIG. 9*a* shows a superconductor ring 66 which may be used in the microstrip, stripline, and printed circuit circulators of FIGS. 4*a*–6*c* in place of superconductor rings 23, 23', and 42 when greater current carrying capability and a stronger magnetic field than can be sustained by rings 23, 23', and 42 is required. Superconductor ring 66 encircles a ferrite element, such as disk 14, for example, and is formed from a plurality of laminated, closed superconductor rings 67. Superconductor ring 66 has a greater cross-sectional area than single layer superconductor rings 23, 23', and 42 and as a result can circulate larger currents without exceeding the critical current density of a particular superconductive material than can rings 23, 23', and 42 .

Figure 9B:
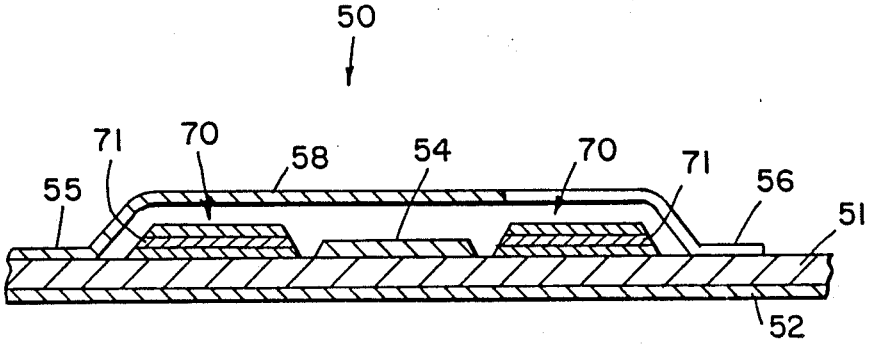
FIG. 9*b* shows a cross-section of a laminated superconductor ring which may be used in the fourth embodiment of the invention.

FIG. 9*b* shows a cross-section of superconductor ring 70 which may be used in the MMIC circulator of FIGS. 7*a* and 7*b* in place of superconductor ring 53 when greater current carrying capability and a stronger magnetic field than can be sustained by ring 53 is required. Superconductor ring 70 is formed from a plurality of laminated, annular rings 71 of superconductive material which surround ferrite element 54. The lowermost ring 71 is deposited on substrate 51 with each of the remaining rings 71 being deposited on top of the lowermost ring. Layers of dielectric may be provided between successive superconductor laminations. Superconductor ring 70 has a greater cross-sectional area than single layer superconductor ring 53 and as a result can circulate larger currents without exceeding the critical current density of a particular superconductive material than can ring 53.

Figure 10A:
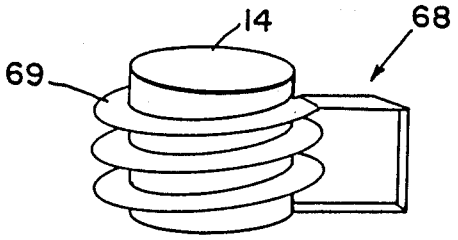
FIG. 10*a* shows a perspective view of a superconductor coil which may be used in the first, second, and third embodiments of the invention.

FIG. 10*a* shows a superconductor coil 68 which may be used in the microstrip, stripline, and printed circuit circulators of FIGS. 4*a*–6*c* in place of superconductor rings 23, 23', and 42 when a stronger magnetic field than can be sustained by rings 23, 23', and 42 without exceeding critical current density is required. Superconductor coil 68 has a plurality of turns 69 which encircle a ferrite element, such as disk 14, and is closed to continuously circulate an induced current. Coil 68 has a greater number of turns than superconductor rings 23, 23', and 42 and as a result can produce a stronger magnetic field at a particular current density than can rings 23, 23', and 42.

Figure 10B:
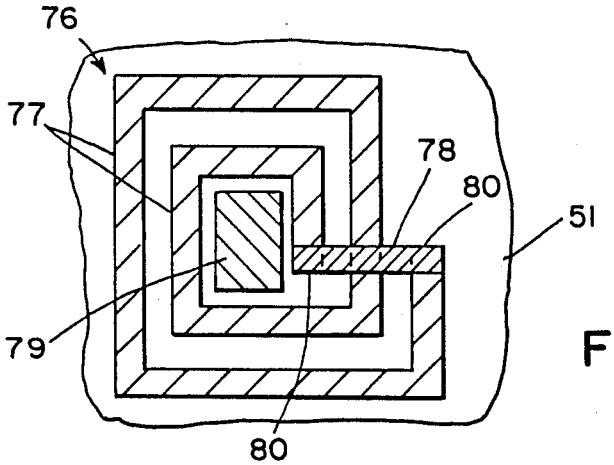
FIG. 10*b* shows a top view of a planar superconductor coil which may be used in the fourth embodiment of the invention.
Figure 10C:
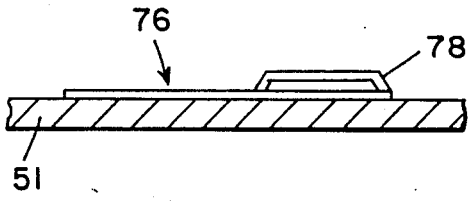
FIG. 10*c* shows a side view of the planar superconductor coil of FIG. 10*b*.

FIGS. 10*b* and 10*c* show top and side views, respectively, of a two-turn planar superconductor coil 76 which may be used in the MMIC circulator of FIGS. 7*a* and 7*b* in place of superconductor ring 53 when a stronger magnetic field than can be sustained by ring 53 without exceeding critical current density is required. Superconductor coil 76 has a plurality of turns 77 which are formed by depositing superconductive material in a spiral shape around the ferrite element on substrate 51. A bridge 78 of superconductive material connects the ends 80 of the spiral shape to close coil 76 and permit an induced current to circulate continuously. Bridge 78 may be an air bridge, as shown in FIGS. 10*b* and 10*c*, formed by well known MMIC techniques and separated from that portion of a turn 77 which lies between ends 80 by an air gap. Alternatively, bridge 78 may be deposited on a dielectric layer which has been deposited on that portion of a turn 77 which lies between ends 80. In this case, bridge 78 is separated from that portion of a turn 77 which lies between ends 80 by the dielectric layer, which may be, silicon nitride, for instance. As seen in FIG. 10*b*, the spiral shape of superconductor coil 76 and the shape of ferrite disk 79 may be rectangular to facilitate mask generation and deposition, although other shapes could also be used. Coil 76 has a greater number of turns than ring 53 and, as a result, can produce a stronger magnetic field at a particular current density than can ring 53.

Figure 10D:
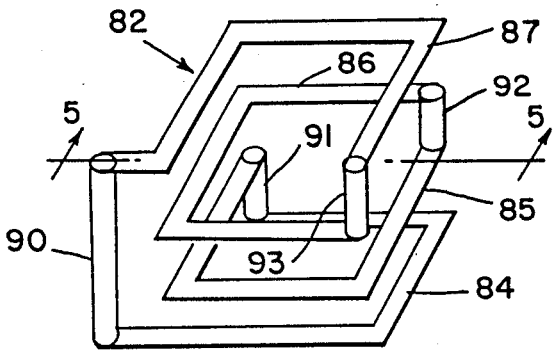
FIG. 10*d* shows a perspective view of a three-dimensional superconductor coil which may be used in the fourth embodiment of the invention.
Figure 10E:
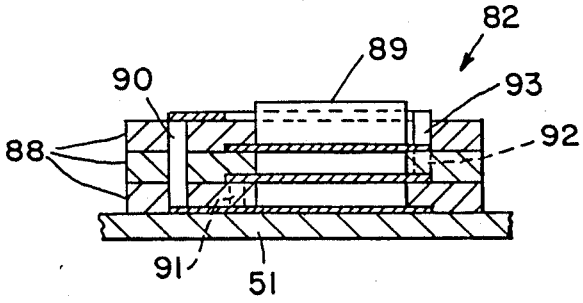
FIG. 10*e* shows a cross-section of the three-dimensional superconductor coil of FIG. 10*d*.

FIG. 10*d* shows a perspective view of a three-dimensional three-turn superconductor coil 82 which may be used in the MMIC circulator of FIGS. 7*a* and 7*b* in place of superconductor ring 53 when a stronger magnetic field than can be sustained by ring 53 without exceeding critical current density is required. FIG. 10*e* shows a cross-section taken along section lines 5—5 of FIG. 10*d*. Coil 82 includes a plurality of substantially U-shaped layers 84, 85, 86, and 87 of superconductive material, each of which partially encircles the ferrite element. Adjacent layers of superconductive material are separated by dielectric layers 88, which may be silicon nitride, for example. Coil 82 is formed by first depositing layer 84 on substrate 51 around the ferrite element and then alternately depositing dielectric layers 88 with layers 85, 86, and 87 of superconductive material. Substrate 51, dielectric layers 88, and ferrite element 89 are not shown in FIG. 10*d* for clarity.

Via holes 90, 91, 92, and 93 are then formed using well-known etching, machine, or laser cutting techniques. Via hole 90 connects layers 84 and 87. Via hole 91 connects layers 84 and 85. Via hole 92 connects layers 85 and 86. Via hole 93 connects layers 86 and 87. Superconductive material is plated, inserted, or deposited in via holes 90–93 to close superconductor coil 82 to permit an induced current to circulate continuously. As shown in FIG. 10*d*, the turns of coil 82 and ferrite element 89 may be rectangular in shape to facilitate mask generation and deposition, although other shapes could also be used. Coil 82 has a greater number of turns than ring 53 and, as a result, can produce a stronger magnetic field at a particular current density than can ring 53.

In addition to the limit in current density which can be sustained in a superconducting material, there is also a limit on the magnetic field density which can be applied to a superconducting material. If this limit, known as critical field, is exceeded, the superconducting material will revert from the superconducting state to the resistive state. Consequently, the number of laminated superconductors 67 and 71 in the superconducting magnets of FIGS. 9*a* and 9*b* and the number of turns on the superconducting magnets 68, 76, and 82 in FIGS. 10*a*–10*e* are limited by the critical field of the superconducting material.

Although several embodiments of the invention have been described as applied to a microstrip, a stripline, a printed circuit, and an MMIC junction circulator having a disk or rectangular shaped ferrite element, the invention is applicable to all ferrite devices which use magnetically biased ferrite elements, including ferrite devices using other types of wave transmission systems and ferrite elements of various shapes.

I claim:

1. A ferrite device, comprising:

a wave transmission means for carrying propagating electromagnetic wave energy;

a ferrite means for controlling the propagation of electromagnetic wave energy in the wave transmission means when biased by a magnetic field; and a superconductor means, which encircles the ferrite means, for producing a magnetic field which magnetically biases the ferrite means, the superconductor means being closed and carrying a continuously circulating current which produces the magnetic field.

2. A ferrite device, as in claim 1, in which the wave transmission means comprises a conductor having a junction and a plurality of transmission lines which extend radially from the junction and the ferrite means is located adjacent the junction.

3. A ferrite device, as in claim 1, in which the superconductor means comprises a plurality of laminated rings of superconductive material.

4. A ferrite device, as in claim 1, in which the superconductor means comprises a coil of superconductive material having a plurality of turns wound around the ferrite means.

5. A circulator, comprising:

a wave transmission means for carrying propagating electromagnetic wave energy, the wave transmission means comprising a conductor having a junction and a plurality of transmission lines which extend radially from the junction;

a ferrite means located adjacent the junction for controlling the propagation of electromagnetic wave energy in the wave transmission means when biased by a magnetic field; and a superconductor means, which encircle the ferrite means, for producing a magnetic field which magnetically biases the ferrite means, the superconductor means being closed and carrying a continuously circulating current which produces the magnetic field.

6. A circulator, as in claim 5, in which the superconductor means comprises a plurality of laminated rings of superconductive material.

7. A circulator, as in claim 5, in which the superconductor means comprises a coil of superconductive material having a plurality of turns wound around the ferrite means.

8. A circulator, comprising:

a substrate;

a ferrite element deposited on the substrate;

a superconductor means encircling the ferrite element for producing a magnetic field to bias the ferrite element;

a plurality of transmission lines deposited on the substrate spaced apart from the superconductor means and extending in a radial direction from the ferrite element; and a junction electrically connecting the transmission lines.

9. A circulator, as in claim 8, in which the superconductor means comprises a ring of superconductive material deposited on the substrate around the ferrite element.

10. A circulator, as in claim 8, in which the superconductor means comprises a first ring of superconductive material deposited on the substrate around the ferrite element and at least one ring of superconductive material deposited on top of the first ring.

11. A circulator, as in claim 8, in which the superconductor means comprises a closed planar coil having a plurality of turns of superconductive material deposited on, the substrate around the ferrite element.

12. A circulator, as in claim 11, in which the plurality of turns includes a pair of ends and the planar coil further comprises a bridge of superconductive material connecting the ends to close the coil.

13. A circulator, as in claim 8, in which the superconductor means comprises a closed three-dimensional coil having a plurality of turns of superconductive material.

14. A circulator, as in claim 13, in which the three-dimensional coil comprises:

a plurality of alternating layers of superconductive material and dielectric material, each of the layers of superconductive material partially encircling the ferrite element; and via holes which are formed in the dielectric material and contain superconductive material to electrically connect the layers of superconductive material to close the coil.

15. A circulator, comprising:

a substrate having a hole;

a plurality of transmission lines which are located on the top surface of the substrate and extend radially from the hole;

a ferrite means mounted in the hole;

a superconductor means encircling the ferrite means for producing a magnetic field to bias the ferrite means; and a junction electrically connecting the transmission lines.

16. A circulator, as in claim 15, in which the superconductor means comprises a ring of superconductive material.

* * * * *